US008881469B1

(12) United States Patent
Meyer

(10) Patent No.: US 8,881,469 B1
(45) Date of Patent: Nov. 11, 2014

(54) CELLULAR CEILING DECK SYSTEM WITH HIDDEN HINGES

(75) Inventor: Brian Jacob Meyer, Columbia, SC (US)

(73) Assignee: Consolidated Systems, Inc., Columbia, SC (US)

( * ) Notice: Subject to any disclaimer, the term of this patent is extended or adjusted under 35 U.S.C. 154(b) by 185 days.

(21) Appl. No.: 13/299,944

(22) Filed: Nov. 18, 2011

Related U.S. Application Data

(60) Provisional application No. 61/414,955, filed on Nov. 18, 2010.

(51) Int. Cl.
*E04B 7/16* (2006.01)

(52) U.S. Cl.
USPC ..... 52/71; 52/745.14; 52/220.1; 52/444; 52/650.3

(58) Field of Classification Search
USPC ..... 52/69, 71, 745.14, 220.1, 220.2, 220.3, 52/220.4, 444, 450, 336, 440; 174/72 A, 174/72 C, 135, 95, 68.1, 101; 248/49; 138/107
See application file for complete search history.

(56) References Cited

U.S. PATENT DOCUMENTS 1,716,038 A * 6/1929 Ferris ..... 49/257
3,049,199 A * 8/1962 Gruber et al. ..... 52/470
3,063,471 A * 11/1962 Murray ..... 138/159
3,304,680 A * 2/1967 Birdwell ..... 52/332
3,959,943 A * 6/1976 Shea et al. ..... 52/783.14
4,041,238 A * 8/1977 Penczak ..... 174/489
4,096,347 A * 6/1978 Penczak et al. ..... 174/486
4,178,469 A * 12/1979 Fork ..... 174/489
4,232,493 A 11/1980 Gray et al.
4,453,349 A 6/1984 Ryan
4,580,379 A 4/1986 Nusbaum
4,593,506 A * 6/1986 Hartman et al. ..... 52/220.4
4,603,523 A * 8/1986 Albrecht et al. ..... 52/220.4
4,738,054 A * 4/1988 Muth et al. ..... 49/386
4,858,401 A 8/1989 Thorp et al.
4,962,622 A 10/1990 Albrecht et al.
4,979,264 A * 12/1990 Ramsauer ..... 16/264
5,057,647 A 10/1991 Bogden et al.
5,140,791 A 8/1992 Kimbrough
5,172,527 A 12/1992 Ault
5,259,157 A 11/1993 Ault
5,327,682 A * 7/1994 Holtz ..... 49/463
5,491,946 A * 2/1996 Landis et al. ..... 52/336
5,778,625 A * 7/1998 Druffel et al. ..... 52/577
5,907,936 A 6/1999 Littrell
5,954,410 A * 9/1999 Noellert ..... 312/242

(Continued)

*Primary Examiner* — Joshua J Michener
*Assistant Examiner* — Matthew Gitlin
(74) *Attorney, Agent, or Firm* — Michael A. Mann; Nexsen Pruet, LLC

(57) ABSTRACT

A deck unit has a hinged, cover panel for use in a deck system as a ceiling. The hinge may be a continuous hinge running the length of the deck unit, preferably a continuous hinge, and extend the length and width of the deck unit including its side flanges or be recessed within it. The edge of access panel cover opposite its hinge is secured using a securing mechanism to a bracket affixed inside the deck unit. By example, a set screw is threaded through a hole in the cover panel, through a weld nut on the inside face of the cover panel and through a U-nut straddling the bracket. Accordingly from a distance, the hinge, latch and the securing mechanism are not visible to indicate that the cover can be opened to permit access to the deck system interior.

19 Claims, 5 Drawing Sheets

(56) References Cited

U.S. PATENT DOCUMENTS

| | | | | |
|---|---|---|---|---|
| 6,107,576 | A * | 8/2000 | Morton et al. | 174/101 |
| 6,449,917 | B1 * | 9/2002 | Sullivan, III | 52/506.06 |
| 6,508,037 | B1 * | 1/2003 | Owen | 52/220.1 |
| 6,576,834 | B2 | 6/2003 | Coutant et al. | |
| 6,691,482 | B1 | 2/2004 | Ault | |
| 6,848,226 | B1 | 2/2005 | Boyd et al. | |
| 7,162,762 | B1 * | 1/2007 | Gleason | 14/71.3 |
| 7,304,240 | B1 * | 12/2007 | Gretz | 174/72 A |
| 7,380,310 | B2 * | 6/2008 | Koessler | 16/267 |
| 7,388,163 | B2 * | 6/2008 | VanderVelde et al. | 174/480 |
| 7,418,807 | B1 | 9/2008 | Ryan et al. | |
| 7,501,576 | B2 * | 3/2009 | Gagliardi | 174/72 A |
| 7,603,814 | B1 | 10/2009 | Hartmann et al. | |
| 7,878,668 | B2 * | 2/2011 | Martinez | 362/20 |
| 8,240,095 | B1 * | 8/2012 | Meyer | 52/220.2 |
| 2002/0043349 | A1 | 4/2002 | Rigby et al. | |
| 2007/0000197 | A1 * | 1/2007 | Patrick et al. | 52/335 |
| 2009/0113806 | A1 * | 5/2009 | Manno | 49/402 |

* cited by examiner

CELLULAR CEILING DECK SYSTEM WITH HIDDEN HINGES

RELATED APPLICATIONS AND PATENTS

Priority is claimed to U.S. Provisional patent application Ser. No. 61/414,955, filed Nov. 18, 2010, which is incorporated herein in its entirety by reference. US non-provisional patent application Ser. No. 11/347,484 filed Feb. 3, 2006 and Ser. No. 12/856,033 filed Aug. 13, 2010 are related to the present application and are hereby incorporated in their entirety by reference.

SUMMARY OF THE INVENTION

Steel deck systems are used in commercial buildings as ceilings because they are both strong and aesthetically pleasing in their long, clean lines. A deck system is made of deck units placed in side-by-side arrangement and joined together in sufficient numbers to form the deck system of the desired size. A layer of concrete or steel may be placed on the deck system for added strength. Each deck unit may be cellular or non-cellular. Cellular deck units define an enclosed space which may be used to conceal conduit, wiring, optic fibers, and piping. Non-cellular deck units may be used where conduit, wiring, optic fibers and piping do not require concealment. Perforated cellular units are closed with a cover panel that is perforated and which units may house sound insulation particularly in the case of deck units that are used in airport terminals or other areas where noise levels are generally higher.

The present invention is an openable, hinged cover panel for deck units that are used as part of a ceiling's deck system. The hinges and latches of the cover panel are obscured from view from below and the cover extends the full length of the deck unit so that the clean lines of the deck system are preserved.

These and other features and their advantages will be readily apparent to those skilled in the art of deck systems from a careful reading of the Detailed Description of Preferred Embodiments, accompanied by the following drawings.

BRIEF DESCRIPTION OF THE DRAWINGS

In the figures.

DETAILED DESCRIPTION OF PREFERRED EMBODIMENTS

The present invention is a deck system for use as a ceiling for a floor or roof. The present deck system may include a layer of concrete or metal plates or other materials applied on top of it depending on its application and whether it is used as a floor or roof.

Figure 1:
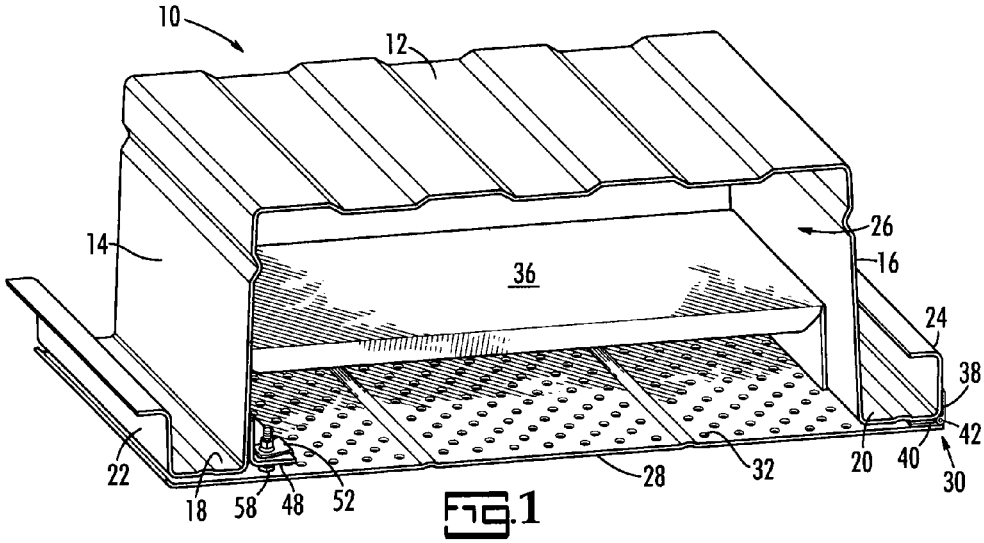
FIG. 1 is an end perspective view of a first profile of a deck unit, according to an embodiment of the present invention.
Figure 2:
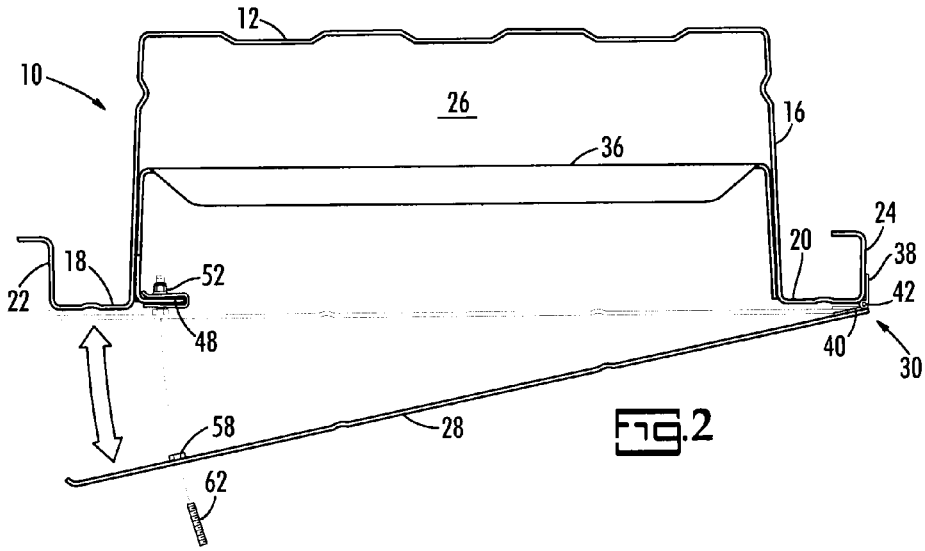
FIG. 2 is an end view of the profile of the deck unit of FIG. 1 with the cover panel opened, according to an embodiment of the present invention.
Figure 3:
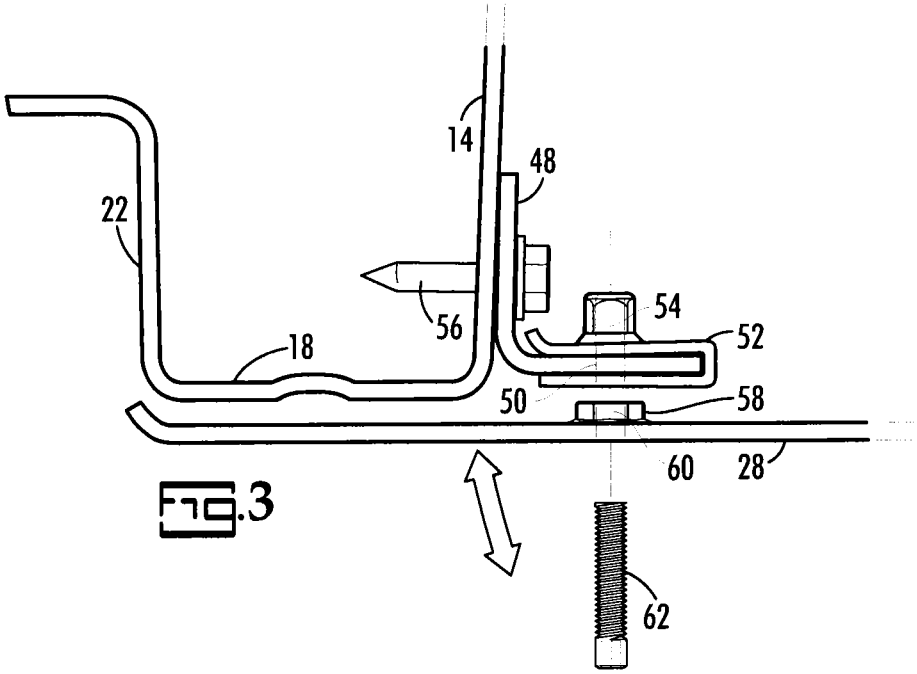
FIG. 3 is a view of a detail of the deck unit of FIG. 1 showing the cover panel U-nut bracket, according to an embodiment of the present invention.
Figure 4:
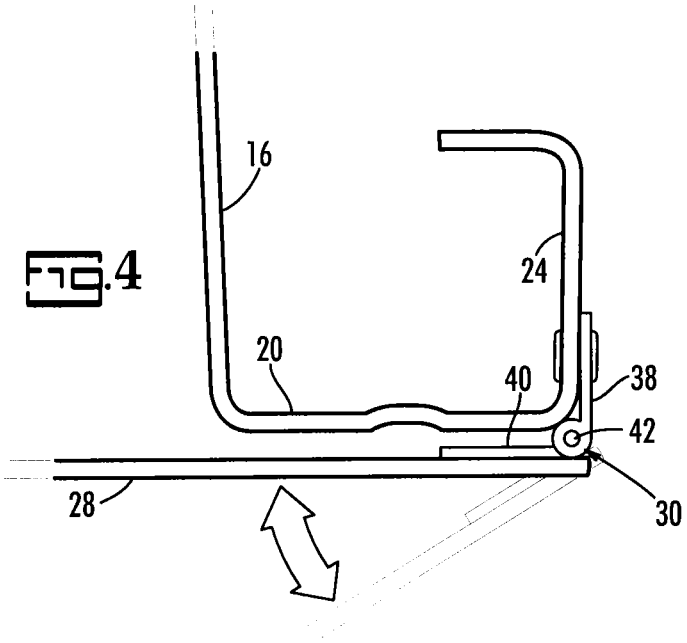
FIG. 4 is a view of a detail of the deck unit of FIG. 1, showing the hinge according to an embodiment of the present invention.
Figure 5:
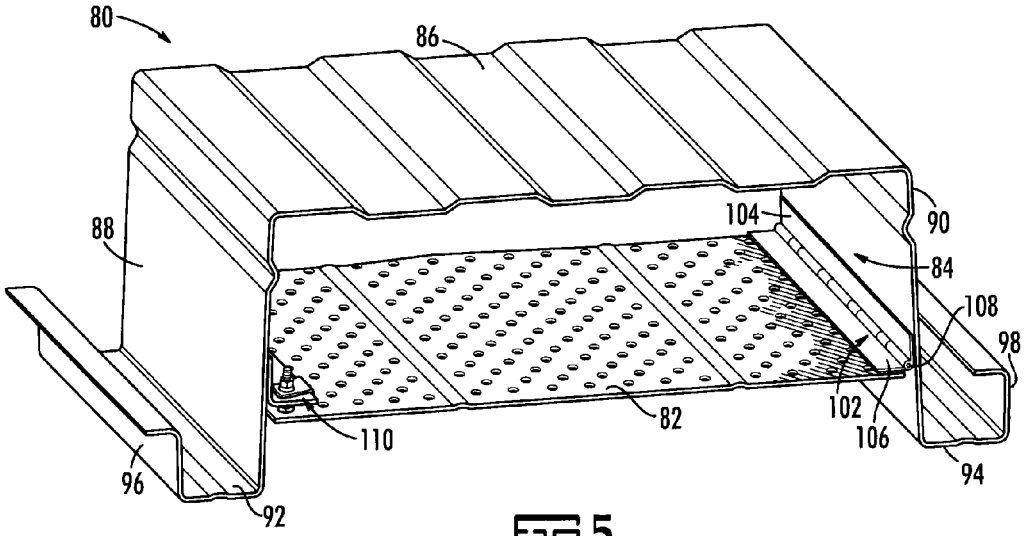
FIG. 5 is an end perspective view of a second profile of a deck unit, according to an embodiment of the present invention.
Figure 6:
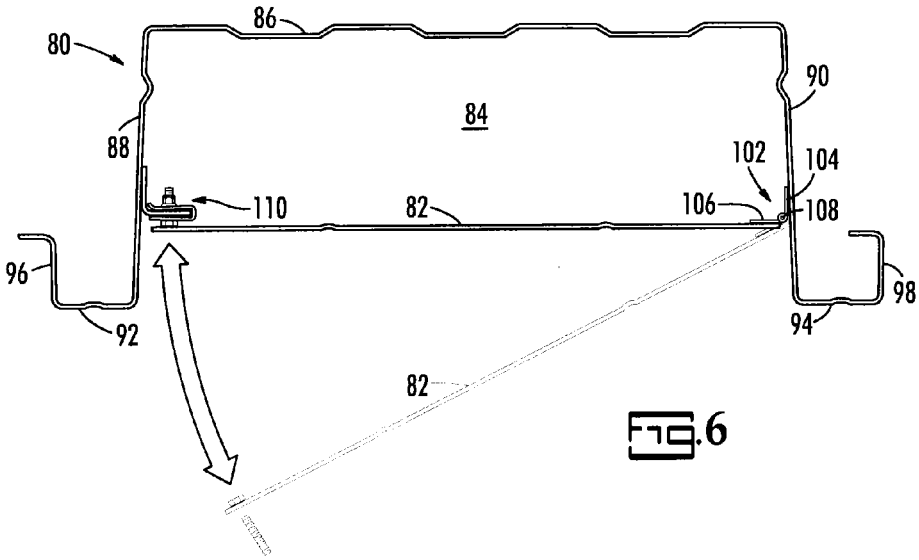
FIG. 6 is an end view of the profile of the deck unit of FIG. 5 with the cover panel opened, according to an embodiment of the present invention.
Figure 7:
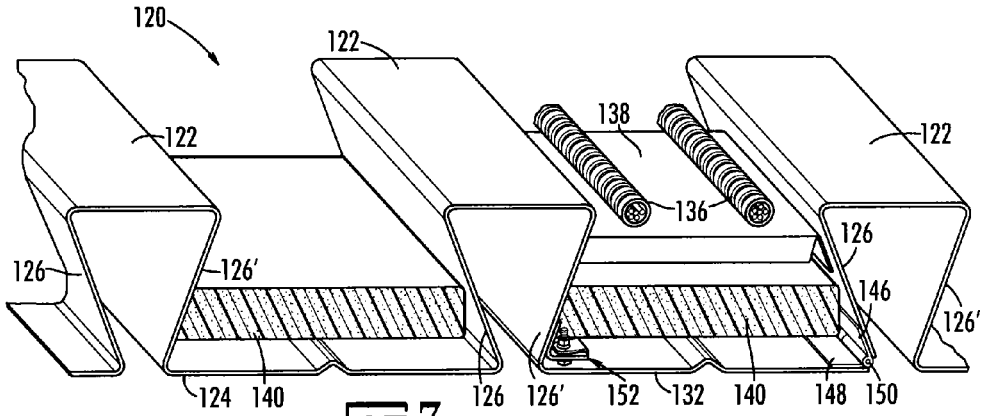
FIG. 7 is an end perspective view of a third profile of a deck unit, according to an embodiment of the present invention.
Figure 8:
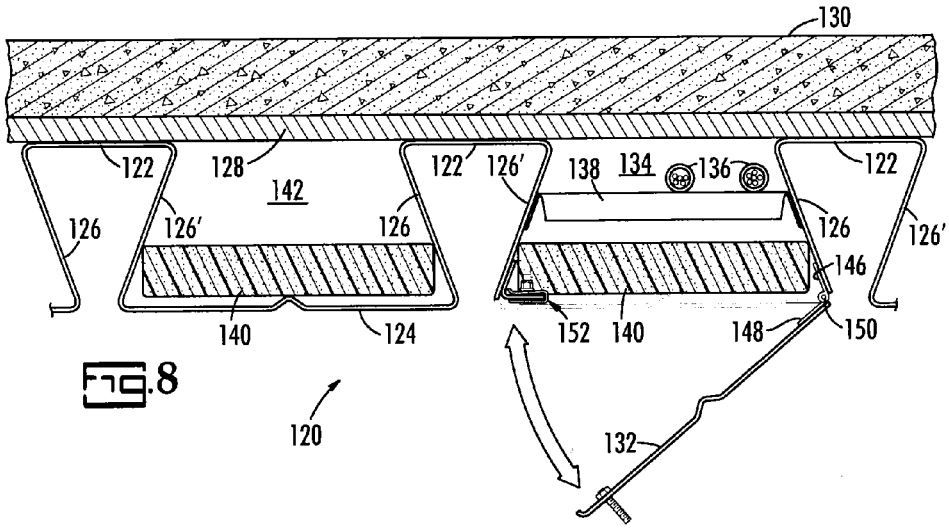
FIGS. 8 and 9 are end views of profiles of the deck unit of FIG. 7 with the cover panel opened and, in FIG. 8, full covering layers of steel and concrete added, and, in FIG. 9, a partial layer of steel and a full and penetrating layer of concrete added, according to an embodiment of the present invention.

The present deck system is composed of individual deck units and are generally indicated by reference number 10 in FIGS. 1 and 2. FIGS. 3 and 4 are detailed drawings of the hinge and latch mechanism of the present deck unit 10 that may be used with any of the three embodiments shown, as well as others. FIGS. 5 and 6 illustrate a second deck unit with a recessed cover panel. FIGS. 7 and 8 illustrate a third deck profile with a cover panel. However, the principles described herein apply in a straight-forward manner to these and other types of deck unit profiles.

Deck unit 10 is made of sheet metal, preferably sheet steel, and formed to have a profile, such as that shown in FIGS. 1 and 2, that is, when viewed from the end, the sheet metal is formed to have the general shape shown in FIGS. 1 and 2 along its full length, (and, alternatively, the shape of the profiles shown in FIGS. 5 and 6, and FIGS. 7 and 8, or other similar profiles) and to be as long as needed to span the gap between supports provided for each end of each deck unit 10 of the deck system to which it belongs.

Deck unit 10 has a top flange 12, two opposing, spaced-apart side walls, namely, first side wall 14 and second side wall 16, with a first side flange 18 and a second side flange 20 extending laterally from first and second side walls 14, 16, respectively. First side flange 18 has a first side lap 22 and second side flange 20 has a second side lap 24. First and second side laps 22, 24, which extend generally perpendicular to first and second side flanges 18, 20, are used for joining deck unit 10 to adjacent deck units 10.

First side wall 14, second side wall 16 and top flange 12 define an interior space 26 that is open from below. Top flange 12, first and second side walls 14, 16, first and second side flanges 18, 20, and first and second side laps 22, 24 may be integrally connected, meaning they are formed by bending or drawing one sheet of metal to have the profile shown in FIGS. 1 and 2. A first side flange 18 from one deck unit 10 will be placed in adjacent relationship with a side flange 20 of an adjacent deck unit 10, to be fastened together, and to others and so on, adding and fastening additional deck units 10 to form a deck system as wide as desired and as long as each deck unit 10 in order to construct a complete deck system. Side laps 22, 24, of deck units 10 may be fastened together by welding or crimping or by use of screws or a combination of such techniques.

A cover panel 28 spans interior space 26 and may run from first side wall 14 to second side wall 20 or may extend to the lateral-most edges of deck unit 10, preferably with a slight radius at the extreme ends of first side flange 18 and second side flange 20 as shown. Cover panel 28 is attached to profile 10 using a hinge 30, thereby closing interior space 26 to be enclosed from below. Hinge 30 permits cover panel 28 to pivot between a closed position wherein cover panel 28 encloses interior space 26 and an open position wherein cover panel 28 swings away from interior space 26.

Cover panel may have a plurality of perforations or through holes 32 that arranged in an array if desired. Holes 32 admit sound waves into interior space 26 where they may be absorbed by, for example, a sound absorbing material (not shown in FIGS. 1 and 2) inside deck unit 10. Deck unit 10 may also have plural spaced-apart struts 36 in interior space 26, running from first side wall 14 to second side wall 16, both to add stiffness and for other uses of interior space 26, such as to provide support for electrical, communication, safety, security and plumbing lines (not shown) in interior space 26.

Hinge 30 may be a full length hinge, such as a continuous hinge, or it may be a series of hinges aligned over the length of deck unit 10. As best seen in FIG. 4, hinge 30 has two leaves, namely, a first leaf 38 and a second leaf 40 pivotally connected by a hinge pin 42. As shown in FIGS. 1 and 2, first leaf 38 may be attached to first side lap 22 and second leaf 40 may be attached to cover panel 28. First and second leaves 38, 40, may be attached to first side lap 22 and cover panel 28, respectively, using screws, bolts, weldments, adhesives or other convenient means. Hinge 30 should be selected and positioned so that its knuckles 66 are just below and just inside of second leaf 40 so that, when one deck unit 10 is placed next to an adjacent deck unit 10, second leaf 40 is between them but, other than a thin gap between deck units 10, first leaf 38 and knuckles 66 are not visible from below.

As best seen in FIG. 3, inside interior space 26, defined by top flange 12 and spaced-apart first and second side walls 14, 16, is a U-nut bracket 48 attached to first side wall 14 as part of the latch of deck unit 10. U-nut bracket 48 may be attached to first side wall 14 using screws 56 or, alternatively, weldments, adhesives, or bolts, as convenient. U-nut bracket 48 includes an elongated hole 50 formed therein. A U-Nut 52 is engaged with U-nut bracket 48 to place a threaded hole 54 in U-nut 52 in registration with the elongated hole 50 of U-nut bracket 48. Elongated hole 50 is elongated parallel to the major dimension of deck unit 10. Elongated hole 50 thus allows a modicum of tolerance parallel to the long dimension of deck unit 10 in the exact location of U-nut 54 with respect to U-nut bracket 48.

U-nut bracket 48 may be attached to first side wall 14 by screws 56, as shown, or by bolts or by welding, as convenient. To enable cover panel 28 to be secured in the closed position, a nut 58 is attached to cover panel 28, preferably to inner surface of cover panel 28 over a hole 32 in cover panel so that hole 32 is aligned with the threaded hole 60 in nut 58, the threaded hole 54 in U-nut 52 and elongated hole 50 of U-nut bracket 48. A hex socket set screw 62 may then be passed through hole 32, threaded hole 60 of nut 58, through U-nut 52 and elongated hole 50 of U-nut bracket 48. Set screw 62, preferably made of a dark metal or painted or coated with a dark color, can be readily found by a worker when close to cover panel 28 but cannot be as easily seen from the floor below after set screw 62 has been rotated just far enough through hole 32 to be approximately flush with the outside surface of cover panel 28.

Cover panel 28 may have beads 68 formed therein to provide stiffness, but, from below, continuous hinge 30 and set screw 62 are not visible so the fact that cover panel 28 is a hinged access to interior space 26 not readily apparent, and the clean lines of deck units 10 joined as a deck system are preserved.

In use, a worker is elevated to deck unit 10 near holes 32 in cover panel 28 to look for the hole 32 where set screw 62 is located. Using a hex head wrench of suitable size, the worker backs set screw 62 out of hole 32 until the distal end of set screw 62 clears U-nut 52. This process is repeated at intervals along the length of deck unit 10 for each set screw 62. At that point, when all set screws 62 of that deck unit 10 have been released, cover panel 28 can be pivoted about continuous hinge 30 to its fully opened position to reveal interior space 26 of deck unit 10 for servicing or installing conduit, piping, wiring, optic cables, light fixture brackets and other utilities, as desired. Once servicing, maintenance or installation has been completed, access cover 28 is rotated back to its fully closed position and set screws 62 are advanced further through nut 58 and into U-nut 52 to secure access cover panel 28 to U-nut bracket 48.

Referring now to FIGS. 5 and 6, there is illustrated a second embodiment of the present invention, a deck unit 80 having a cover panel 82 to enclose an interior space 84 and recessed therein. Deck unit 80 includes top flange 86, each having a first side wall 88 and an opposing second side wall 90 to partially define interior space 84. First side wall 88 has a lateral first side flange 92 and a second side wall 90 is attached to a lateral second side flange 94. First side flange 92 includes a first side lap 96 extending generally perpendicular to it; second side flange has a corresponding second side lap 98. First and second side laps 96, 98, are used to join together adjacent deck units 80. Decking unit 80 is formed from a single sheet of metal, preferably steel.

Cover panel 82 is attached to deck unit 80 in a manner similar to the way cover panel 28 is joined to deck unit 10, namely with a hinge 102 having a first leaf 104 and a second leaf 106 that pivot with respect to each other about pivot pin 108. First leaf 104, however, is attached to second side wall 90 of deck unit 80 rather than to second side lap 24 of deck unit 10. Second leaf 106 is attached to cover panel 82.

Cover panel 82 includes a latch 110 similar to that illustrated in FIG. 3.

Figure 9:
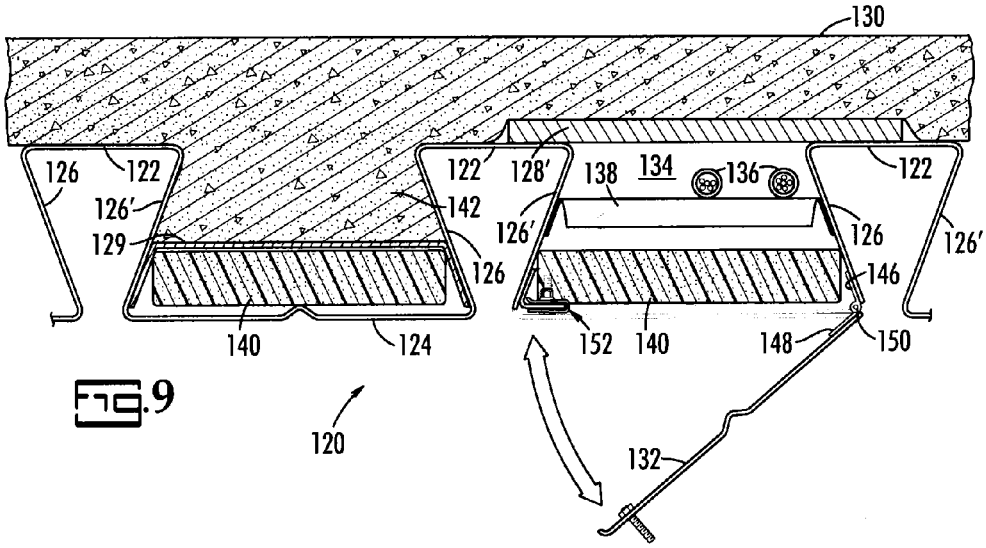

FIGS. 7 and 8 illustrate the present invention in a reentrant-type deck unit 120, which includes plural top flanges 122, plural bottom flanges 124, and first and second side walls 126, 126', connecting top flanges 122 to bottom flanges 124, respectively. FIG. 8 illustrates deck unit 120 with a sheet of steel 128 attached to deck unit 120 and a layer of concrete 130 on top flanges 122. Steel 128 may carry embossments. FIG. 9 is similar to FIG. 8 except that the attached sheet of steel 128' extends only over the hinged cell portion of deck unit 120. In FIG. 9, a cap or hat 129 running the full length of deck unit 120 covers sound insulation 140 in the non-hinged portion of deck unit 120 to protect it from the inflowing of the concrete layer that compositely interacts with deck unit 120.

A cover panel 132 runs from the bottom edges of first and second side walls 126, 126', to enclose the interior space 134 above it and allow that space to contain, for example, conduit 136 supported on struts 138 (one shown) and sound insulation 140 below struts 138. Sound insulation 140 may also be installed in other interior spaces 142 of deck unit 120 above bottom flanges 124 of deck unit 120. Cover panel 132 and bottom flanges 124 may be perforated to pass sound waves into interior spaces 134 and 142 for absorption by sound insulation 140.

Cover panel 132 is attached to wall 126 by a hinge 144. Hinge 144 has a first leaf 146 and a second leaf 148 pivotally attached to first leaf 146 by a pivot pin 150. First leaf 146 is attached to cover panel 132 and second leaf 148 is attached to wall 126. Cover panel 132 swings from an open position to a closed position where it may be secured by a latch 152 similar to that shown in FIG. 3.

The present invention preserves the clean lines of a traditional deck system while allowing ready access to the utilities the deck units of that deck system is carrying when and as needed.

Those skilled in the art of metal deck systems will appreciate that substitutions and modifications can be made to the foregoing embodiments without departing from the spirit and scope of the present invention, which is defined by the appended claims.

What is claimed is:

1. A deck unit for use as part of a deck system, said deck unit comprising:

(a) a sheet of metal formed of one sheet of metal by bending or drawing to a profile having
  (i) a top flange,
  (ii) a first side wall,
  (iii) a second side wall opposing said first side wall, said first and said second side walls integrally connected to said top flange and together defining an interior space,
  (iv) a first side flange integrally connected to said first side wall,
  (v) a second side flange integrally connected to said second side wall,
  (vi) a first side lap integrally connected to said first side flange, and
  (vii) a second side lap integrally connected to said second side flange;

(b) a cover panel to close said interior space;

(c) a hinge attached to said profiled sheet and said cover, said hinge allowing said cover to move between a closed position enclosing said interior space and an open position away from said interior space; and (d) a latch carried by said second side wall to secure said cover in said closed position, and wherein said latch further comprises: a U-nut bracket carried by said second side wall, said U-nut bracket having a hole; and a U-nut carried by said U-nut bracket, said U-nut having a threaded hole, said threaded hole of said U-nut being in registration with said hole in said U-nut bracket.

2. The deck unit as recited in claim 1, wherein said hinge further comprises a first leaf and a second leaf pivotally joined together, said first leaf being attached to said first side lap and said second leaf being attached to said cover, said cover having a closed position wherein said cover engages said second side flange, and an open position wherein said cover does not engage said second side flange.

3. The deck unit as recited in claim 1, wherein said hinge further comprises a first leaf and a second leaf pivotally joined together, said first leaf being attached to said first side wall and said second leaf being attached to said cover, said cover having a closed position wherein said cover engages said second side wall, and an open position wherein said cover does not engage said second side wall.

4. The deck unit as recited in claim 1, wherein said latch further comprises:

(a) a nut with a threaded hole carried by said cover;

(b) a bracket carried by said second side wall, said bracket having a hole formed therein;

(c) a nut attached to said bracket, said nut attached to said bracket having a threaded hole, and wherein said hole in said bracket, said nut carried by said bracket, and said nut carried by said cover are in registration; and (d) a threaded screw dimensioned for threading into said threaded hole in said nut carried by said cover and said threaded nut carried by said bracket, whereby said cover can be latched in said closed position.

5. The deck unit as recited in claim 4, wherein said hole in said bracket is elongated.

6. The deck unit as recited in claim 4, wherein said cover has at least one hole formed therein and said threaded screw is dimensioned to fit through a hole of said holes.

7. The deck unit as recited in claim 1, wherein said hinge is a continuous hinge.

8. A deck system, comprising plural deck units joined together, each deck unit of said plural deck units having (a) a sheet of metal formed b bending or drawing one sheet of metal to have a profile with
  (i) a top flange,
  (ii) a first side wall,
  (iii) a second side wall opposing said first side wall, said first and said second side walls integrally connected to said top flange and together defining an interior space,
  (iv) a first side flange integrally connected to said first side wall, and
  (v) a second side flange integrally connected to said second side wall, (b) a cover panel running from said first side wall to said second side wall to close said interior space;

(c) a hinge attached to said profile and said cover, said cover having a closed position wherein said cover closes said interior space, and an open position wherein said cover does not close said interior space; and (d) a latch carried by said second side wall to secure said cover in said closed position, and wherein said latch further comprises: a U-nut bracket carried by said second side wall, said U-nut bracket having a hole; and a U-nut carried by said U-nut bracket, said U-nut having a threaded hole, said threaded hole of said U-nut being in registration with said hole in said U-nut bracket.

9. The deck system as recited in claim 8, further comprising a layer of concrete carried on said plural deck units.

10. The deck system as recited in claim 8, further comprising a metal plate carried on said plural deck units.

11. The deck system as recited in claim 8, wherein said hinge is a continuous hinge.

12. The deck system as recited in claim 8, wherein said cover is perforated.

13. The deck system as recited in claim 8, further comprising insulation in said interior space.

14. The deck system as recited in claim 8, further comprising struts in said interior space and attached to said first side wall and said second side wall.

15. A method for making a decking unit, said method comprising:

(a) forming a sheet of metal by bending or drawing one sheet of metal into a profile having
  (i) a top flange,
  (ii) a first side wall,
  (iii) a second side wall opposing said first side wall, said first and said second side walls and said top flange together defining an interior space,
  (iv) a first side flange adjacent to said first side wall,
  (v) a second side flange adjacent to said second side wall,
  (vi) a first side lap adjacent to said first side flange, and
  (vii) a second side lap adjacent to said second side flange;

(b) forming a cover for enclosing said interior space;

(c) attaching said cover to said profile with a hinge so that said deck unit has a closed position with said cover enclosing said interior space and an open position with said cover pivoted away from a said interior space; and (d) attaching a latch to said cover and said profile to openably secure said cover to said profile so that, when desired, said cover can be unsecured and opened by unlatching said latch and pivoting said cover to said open position from said closed position, and wherein said latch further comprises: a U-nut bracket carried by said second side wall, said U-nut bracket having a hole; and a U-nut carried by said U-nut bracket, said U-nut having a threaded hole, said threaded hole of said U-nut being in registration with said hole in said U-nut bracket.

16. The method as recited in claim 15, further comprising the step of installing struts in said interior space and secured to said first side wall and said second side wall.

17. The method as recited in claim 15, wherein said cover has at least one hole and wherein said latch is positioned so that it can be accessed through said at least one hole.

18. A method of making a deck system, said method comprising the steps of (a) forming plural deck units, each deck unit of said plural deck units formed by bending or drawing one sheet of metal into a profile having (i) a top flange, (ii) a first side wall, (iii) a second side wall opposing said first side wall, said first and said second side walls integrally connected to said top flange and together defining an interior space, (iv) a first side flange integrally connected to said first side wall, (v) a second side flange integrally connected to said second side wall, (vi) a first side lap integrally connected to said first side flange, and (vii) a second side lap integrally connected to said second side flange;

(b) forming a cover for enclosing said interior space of said each deck unit;

(c) attaching said cover to said profile for said each deck unit with a hinge so that said each deck unit has a closed position with said cover enclosing said interior space and an open position with said cover pivoted away from a said interior space; and (d) attaching a latch to said cover and said profile of said each deck unit to openably secure said cover to said profile so that, when desired, said cover can be unsecured and opened by unlatching said latch and pivoting said cover to said open position from said closed position, and wherein said latch further comprises: a U-nut bracket carried by said second side wall, said U-nut bracket having a hole; and a U-nut carried by said U-nut bracket, said U-nut having a threaded hole, said threaded hole of said U-nut being in registration with said hole in said U-nut bracket (e) joining said plural deck units together.

19. The method as recited in claim 18, further comprising the step of applying a layer of concrete to said joined deck units.

* * * * *